United States Patent [19]

Fernandez

[11] 4,185,828

[45] Jan. 29, 1980

[54] MACHINE AIR PRESSURIZED GAME

[76] Inventor: Lazaro Fernandez, 263 Willis Ave., Mineola, N.Y. 11501

[21] Appl. No.: 840,607

[22] Filed: Oct. 11, 1977

[51] Int. Cl.[2] ..... A63F 3/06; A63F 5/04

[52] U.S. Cl. ..... 273/142 J; 273/144 A; 273/144 B; 273/145 CA

[58] Field of Search ..... 273/144 R, 144 A, 144 B, 273/142 R, 142 A, 142 B, 142 C, 142 D, 142 E, 142 F, 142 G, 142 H, 142 HA, 142 J, 142 JA, 142 JB, 142 JC, 142 JD, 142 K, 95 C

[56] References Cited

U.S. PATENT DOCUMENTS

| | | | |
|---|---|---|---|
| 1,776,196 | 9/1930 | Rochwarg | 273/95 C |
| 2,055,498 | 9/1936 | Jacobs | 273/144 R X |
| 2,091,883 | 8/1937 | Rochwarg | 273/144 R X |
| 2,315,323 | 3/1943 | Fostos | 273/144 A |
| 2,621,042 | 12/1952 | Stein et al. | 273/144 R X |
| 2,831,692 | 4/1958 | Keast | 273/145 E |
| 3,044,780 | 7/1962 | Silverman | 273/144 A |
| 3,141,674 | 7/1964 | Hoffman | 273/142 R |
| 3,334,422 | 8/1967 | Little | 273/95 C X |
| 4,095,794 | 6/1978 | Garto et al. | 273/101 |

FOREIGN PATENT DOCUMENTS

| | | | |
|---|---|---|---|
| 552168 | 1/1958 | Canada | 273/144 B |
| 494073 | 10/1938 | United Kingdom | 273/142 A |
| 1078815 | 8/1967 | United Kingdom | 273/144 R |

*Primary Examiner*—Richard C. Pinkham
*Assistant Examiner*—Arnold W. Kramer
*Attorney, Agent, or Firm*—Herbert L. Lerner

[57] ABSTRACT

An air pressurized game machine has a self-contained unitary multi-way valve assembly having at least one positive air pressure supply inlet with a multiplicity of positive air pressure outlets each having separate actuators for controlling air to tubes to perform different functions. A lot mixing or agitating chamber has horizontal and vertical outlets for blowing air in these respective directions and the lot is captured and then may be manually positioned in holes in a grid. The bottom of the holes are closed by air actuated flaps. A box below the flaps captures the lot and additional tubes can agitate the lot in the box or return it to the agitating chamber. An additional function is a roulette wheel rotated under action of the forced air.

13 Claims, 8 Drawing Figures

MACHINE AIR PRESSURIZED GAME

The invention relates to a game machine and more particularly to a machine which is adaptable to playing a variety of games of chance.

Permanent bingo parlors and organizational fund raising using games are increasingly more popular today. However, the conventional equipment such as for playing bingo is manual and very slow and limited in its ability to provide winning numbers totally by chance. Good roulette machinery is extremely expensive and lesser expensive equipment is generally unsatisfactory in terms of being totally fair and by change. Equipment and tables for playing dice games such as craps is also expensive and very cumbersome, making it impossible to move the equipment on a rotating basis. Numbers, on the other hand, is usually not played with machinery, and has the disadvantage of not being playable to completion at one sitting. Furthermore, the machinery available for these games is specialized and can only be used to play one type of game and none of these devices can operate more than one game at a time.

It is therefore an object of the invention of the instant application to overcome the above-mentioned problems and shortcomings of the heretofore known devices of this general type and to provide a game machine which is small enough to be portable, provides winning values or numbers automatically and completely by chance, can easily convert to operation for a variety of different games of which several can be played at the same time, provides new ways of playing popular games and is relatively quick and inexpensive. The game machine can also be played with a variety of different lot members, such as balls, dice, or other solids capable of determining a winning value with the game machine. It will become evident that the invention is also adaptable to playing several other games not mentioned above, such as colors and Spanish lottery.

With the foregoing and other objects in view, there is provided in accordance with the invention, a game machine including a chamber for receiving therein at least one lot member, valve means for controlling a supply of forced air to the chamber, means cooperating with the valve means for agitating the lot member in the chamber so that it freely whirls about the chamber, and means for capturing and positioning the lot member at random at a location at which a value characteristic of the lot member at the location is displayed.

For playing dice or one form of roulette, the chamber may be attached to the valve by a hose and used at a distance from the game machine. Several dice chambers may also be used at one time. Therefore, in accordance with another feature of the invention, it is provided that the lot member is a die, the chamber means are in the form of a head for playing dice, the capturing and positioning means comprise a bowl-shaped upper portion of the head having an annular trough and formed with openings therein for emitting the die therethrough onto the annular trough, the head being connectible to the valve means.

For playing numbers and bingo, a universal head or chamber is used with tubular head attachments. Therefore, in accordance with a further feature of the invention, there is provided a tubular head attachment partly received in the chamber means and having an end extending out of the chamber means and an open end within the chamber means for receiving the lot member therein under action of the forced air, the end extending out of the chamber means being partly closed to passage of the lot member and pervious to the forced air.

In order to read the numbers printed on the lot member when playing numbers in accordance with an additional feature of the invention, it is provided that at least the partly closed end of the tubular head attachment is transparent.

In order to play the game of colors in accordance with yet another feature of the invention, it is provided that the chamber means is pervious to the forced air, and the capturing and positioning means comprise a tube for receiving the lot member therein under the action of the forced air, the tube being partly received in the chamber means and having an end extending out of the chamber means and an open end within the chamber means, a box having an open bottom formed therein, the box being connected to the end extending out of the chamber means for receiving the lot member from the tube, a grid disposed at the open bottom of the box for receiving the lot member from the box, and means for returning the lot member to the chamber means.

In accordance with a still further feature of the invention, it is provided that at least part of the box is transparent, and the grid and flaps have differently colored areas.

In accordance with yet an additional feature of the invention, it is provided that the returning means comprise flaps disposed under the grid for retaining the lot member in the grid, the flaps being releasable to allow the lot member to fall below the grid, an additional box disposed below the grid for receiving the lot member therein, a hose connected at one end to the additional box and at the other end to the chamber means for returning the lot member therein under the action of the forced air.

In order to play bingo, in accordance with another feature of the invention, it is provided that the member is a ball, and including a tubular head attachment partly received in the chamber means and having an end extending out of the chamber means and an open end within the chamber means for receiving the ball under the action of the forced air, the end extending out of the chamber means being pervious to the forced air and having a hole formed therein, the hole having a diameter slightly smaller than that of the ball, whereby the ball is lodgable in the hole, and including means for returning the ball to the chamber means.

In accordance with a further feature of the invention, it is provided that the returning means comprise flaps disposed under the grid for retaining the ball in the grid, the flaps being releasable to allow the ball to fall below the grid, an additional box disposed below the grid for receiving the ball therein, a hose connected at one end to the additional box and at the other end to the chamber means for returning the ball therein under the action of the forced air.

Another type of roulette may be played remotely in the same fashion as dice, and several dice and roulette games may be carried on simultaneously. Therefore, in accordance with an additional feature of the invention, there is provided a box for playing roulette connectible to the valve means, the box having a roulette wheel disposed therein, the wheel being rotatable under the action of the forced air, and means for randomly selecting and displaying a winning value on the wheel.

In accordance with a concommitant feature of the invention, it is provided that the wheel has a front and a rear surface and including fins integral with the rear surface and ridges integral with the front surface, the action of the forced air rotating the wheel by impinging the fins, the selecting means being a flexible finger engageable with the ridges for stopping the rotation of the wheel.

Other features which are considered as characteristic for the invention are set forth in the appended claims.

Although the invention is illustrated and described herein as embodied in a game machine, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which.

Figure 1:
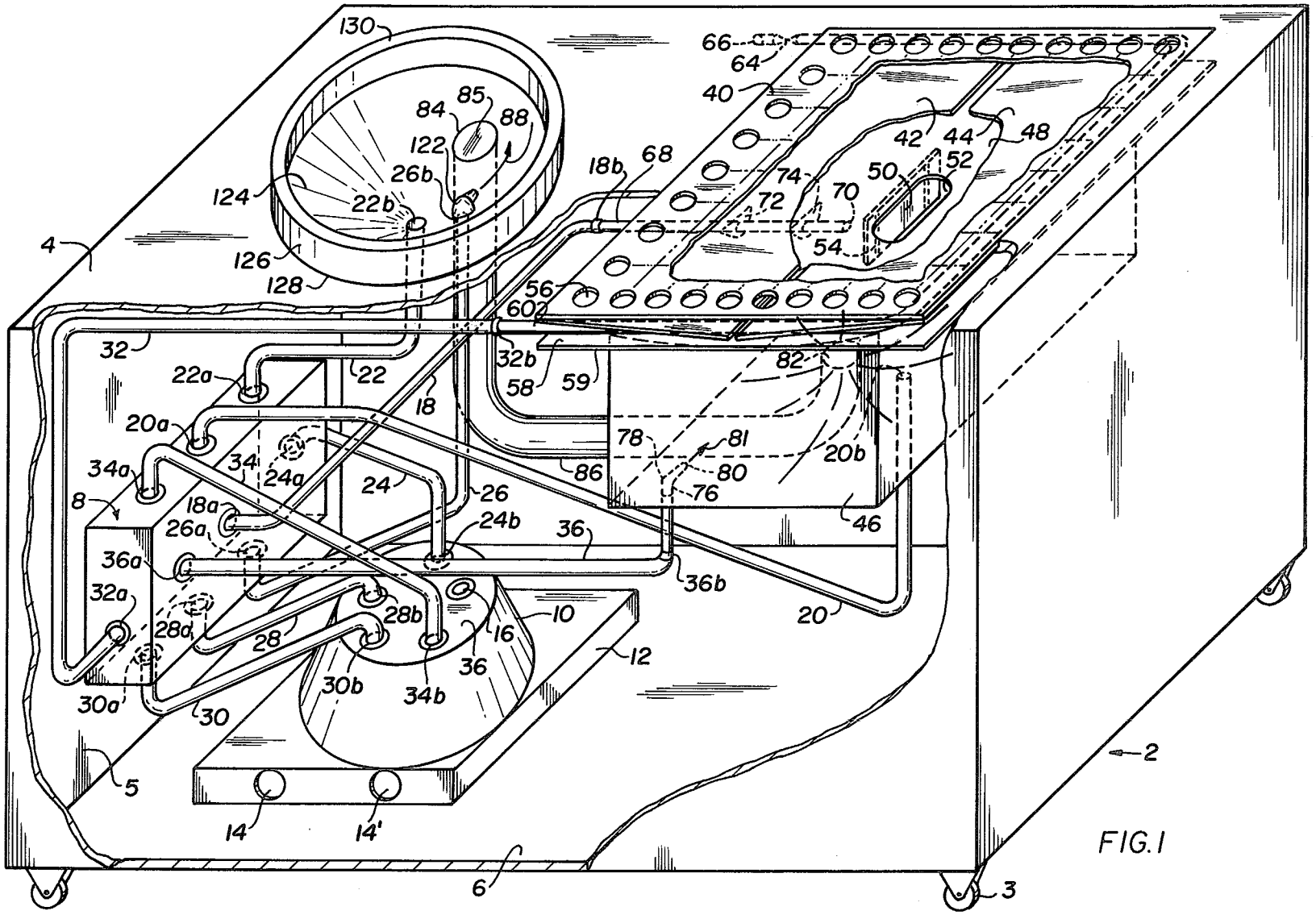
FIG. 1 is a perspective view of the game ball machine of the invention, partly broken away.

Referring now to the drawings and first, particularly to FIG. 1 thereof, there is seen a game machine 2 in the shape of a rectangular box which is movable on rollers 3. Mounted on the top surface 4 of the game machine 2 is a collar or ring 126 which accepts any one of a number of heads or chambers constructed for use with different games. These heads will be discussed later. The collar 126 is attached at its lower edge 128 to the edge of a cutout formed in the top surface 4. A conical dish 124 is also attached at the lower edge 128 or may be formed as one unit with the collar 126. The collar 126 has a top edge or lip 130 which is dimensioned to act as the female end of the connection with the heads mentioned above. There are several holes in the dish 124, to be discussed hereinafter.

A rectangular game ball grid 40 is also disposed in a cutout on the top surface 4 of the game ball machine 2. The grid 40 shown in the drawing has 90 holes 56, in rows of 10 on one edge and rows of 9 on the other, for use with bingo which requires 75 holes or a similar game. Spanish lottery using 90 holes, but may have more or less holes 56 depending on the type of game to be played. For bingo, the holes 56 are numbered from 1 to 15 and letters B, I, N, G or O, and the balls or lot members are marked similarly so that a typical winning number would be 36/N or 64/O. The grid may alternately have 15 numbered holes along one edge and 5 lettered holes along the other.

A box 46 is suspended from under the top surface 4. The top 58 of the box 46 has a flat outer ledge 59 and a depressed center portion 48 having an oval cutout 52 formed therein. In the bottom of the box 46 are several holes to be discussed hereinafter. Adjacent the slot 52 is a flap 50 which is hinged to the depressed center portion 48 of the box and is reinforced with stiffening members 54. The flap 50 which is shown in the vertical position in FIG. 1 is just large enough to fully cover the slot 52 when in the horizontal position. The flap 50 is pushed into the horizontal position by air passing through the opening 70 of a tube 68 which is suspended by hangers 72, 74.

Two flaps 42, 44 are hinged to the long edges of the rectangular game ball grid 40. The flaps 42, 44 which are shown in the lowered or relaxed position in FIG. 1, cover most of the holes 56 entirely when in the raised position and a large portion of the holes which are not covered completely. Between the top of the ledge 59 and the underside of the flaps 42, 44 is a balloon or air bag 60. The air bag 60 extends under three sides of the grid 40 and is vented at one end 66. The venting of the air bag 60 is controlled by a valve 64 and when inflated lifts the flaps 42, 44 into the raised position where they close off the holes 56.

Mounted on the bottom surface 6 of the game ball machine 2 is a blower 10 on a base 12. The five holes in the upper surface 36 of the blower 10 each are capable of producing a positive flow of air, although one hole 16 is closed in normal operation and is used for connection to an auxiliary source of air if necessary. The two holes 14, 14' in the base 12 take in air to be forced out of the blower 10.

Figure 2:
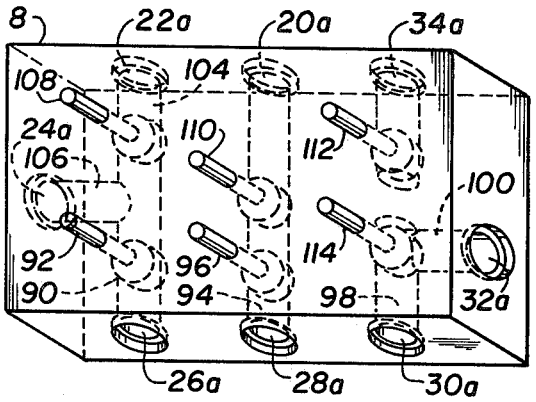
FIG. 2 is a perspective view on an enlarged scale of the valve and air box assembly as seen from the opposite side shown in FIG. 1.

On the left side wall 5 of the game machine 2, as shown in FIG. 1, is a multi-controlled air box and valve assembly 8. The valve assembly 8 has ten holes which are connected to air hoses which supply power to the various parts of the game machine 2. The passage of air through the ten hoses 18, 20, 22, 24, 26, 28, 30, 32, 34, 36 is controlled by six valves 92, 96, 108, 110, 112, 114. The actuators which control these valves pass through an opening in the side wall 5. FIG. 2 shows the valve removed from the game ball machine 2 with the hoses disconnected.

Figure 3:
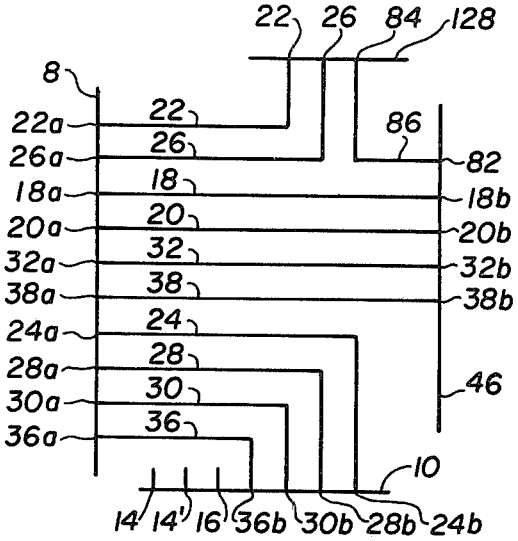
FIG. 3 is a schematic diagram of the hoses shown in FIG. 1.

The following explanation of the operation of the game ball machine will be best understood with reference to the schematic hose connection diagram of FIG. 3 as well as FIGS. 1 and 2. All of the air flow for the game ball machine emanates from the blower 10 and passes through the valve 8 to the dish 124 or to the box 46. The dish 124 may be covered with one of several game ball heads or chambers, to be described hereinafter.

Figure 6:
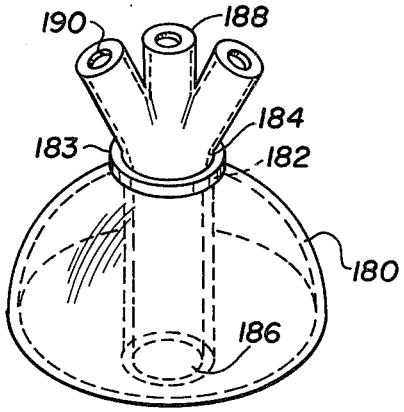
FIG. 6 is a perspective view of a universal head of the invention equipped with a three-digit numbers or roulette insert head attachment.

When playing bingo, 90 light weight balls or lot members are placed in the dish 124. The universal head or chamber 180 shown in FIG. 6 is placed within the lip 130 of the collar 126. The tubular or bingo head attachment 200 is placed in the cutout 182 of the universal head 180. The blower 10 is turned on and the horizontal air valve 92 is opened. This allows the flow of air from the blower 10 through the hose 24 connected between hole 24*b* of the blower to hole 24*a* of the valve assembly 8. The air then flows through passageway 106 within the valve, shown in FIG. 2, out the valve opening 26*a*. From opening 26*a* the air flow continues through hose 26 to opening 26*b* in the dish 124. A nozzle 120 covers the hole 26*b* and directs air through the opening 122 in a circular or horizontal path in the direction of the arrow 88, around the dish 124. This horizontal air flow thoroughly mixes the numbered balls.

When it is desired to receive a number for bingo, the vertical air valve 108 is opened. This allows air from the passageway 106 in the valve to be partially deflected through opening 22a in the valve into hose 22 which is connected to hole 22b in the center of the dish 124. Air is then forced upward and carries one or more numbered balls into the opening 202 of frustoconical neck of the bingo attachment 200. This neck may, of course, be cylindrical. Two or three balls gather inside the bubble 208 after having passed through the neck opening 204 above the horizontal surface 206. The tubular attachment 200 is pervious to the passage of air and the air vent 210 allows air to escape so that a flow is maintained. The large opening 212 allows part of a ball to pass therethrough due to the force of the air. The uppermost game ball is then manually removed from the hole 212 and its number is read to the bingo players and displayed on a large board not shown. After each new number is received, the vertical air valve 108 is closed and balls mix horizontally again. The vertical air valve 108 and the horizontal air valve 92 may be operated simultaneously to give varying degrees of horizontal and vertical movement.

When each numbered ball is removed from the bingo attachment, it is placed on the grid 40 in one of the holes 56. The odds of receiving a particular number are 75 to 1 or 90 to 1 depending on the game played. These odds steadily improve as holes 56 are filled. The flaps 42, 44 are maintained in the raised position by a positive pressure in the air bag 60. The balls are therefore held in the grid 40 by the flaps 42, 44 as follows. Air flowing from the opening 30b in the blower 10 through the hose 30 enters the valve 8 through the opening 30a and flows into the passageway 98 in the valve assembly 8. The valve 114 is normally in the open position unless specifically closed. This allows air to flow through the passageway 100 out the opening 32a and through hose 32 into the opening 32b of the air bag 60.

When a player gets bingo or the game has otherwise ended, the valve 114 is closed and the air bag 60 collapses allowing the flaps 42, 44 to lower and the numbered balls to drop from the grid and roll along the curved upper portion 48 of the box 46 through the slot 52 formed therein and into the box 46. The valve 114 is then opened and the air bag 60 is inflated.

When the game is to be started again, the valves 96 and 110 are opened, and air is permitted to flow from the opening 28b in the blower 10 through the hose 28 and the opening 28a in the valve assembly 8. This fills passageway 94 with air which flows through valves 96 and 110 into hoses 18 and 20 from their connections at respective openings 18a and 20a. The air from hose 18 enters the tube 68 and pushes the flap 50 into an angle of approximately 45° with the top 48 of the box 46. The air from hose 20 enters the bottom of the box 46 through hole 20b and completely closes the flap 50, horizontally sealing off the slot 52. The valve 96 may now be closed. The only outlet for air to escape the box 46 is through the opening 82 in the bottom thereof. This opening 82 is connected to one end of a hose 86. The other end of the hose 86 is connected to the opening 84 in the dish 124 covered by a one-way flap. The openings 82, 84 and the hose 86 are the only ones large enough to accept the game balls. The balls are therefore rapidly pushed from the box 46 through the hose 86 into the dish 124 past the flap 85. The balls are now in a position to restart the game and valves 96 and 110 are closed. If the balls should accumulate in one corner of the box 46 and not flow into the hose 86, air may be introduced into the box to move the balls. This is accomplished as follows. Air flows from the opening 34b in the blower 10 through the hose 34 and into the valve assembly 8 at the opening 34a. This fills the passageway 102 with air. When the valve 112 is opened, this air flows through opening 36a into hose 36 and into the tube 76 in the bottom of the box through its opening 36b. The air is directed through nozzle 78 and out opening 80 in the direction of the arrow 81.

To play roulette or numbers as in a lottery drawing, the same basic universal head or chamber 180 shown in FIG. 6 is used as in bingo.

Numbers is generally played with one thousand possible winning numbers from 0 to 999, but can also be played with one hundred, ten or any multiple of ten numbers. To play numbers with the game machine of the invention, the universal head or chamber 180 shown in FIG. 6 is used in combination with the tubular head attachment 184. The tubular head attachment 184 has a collar 183 which rests on the top of the universal head 180 when inserted into the cutout 182. After mixing the game balls or lot members in the dish 124 through the use of the horizontal air valve 92, the vertical air valve 108 is opened and several balls are forced through the opening 186 in the tubular attachment 184 and into the necks or tubes 188. The opening 186 is spaced a distance above the dish 124 to allow mixing. Air vents 190 which are pervious to the passage of air are placed at the top of each neck to maintain air flow. The vents 190 are too small to allow the game balls to escape therethrough. When playing with one thousand possible winning numbers, thirty game balls made up of three sets of balls numbered from 0 to 9 are used with three necks 188 as shown in FIG. 6. If one hundred possible winning numbers are used, two necks and two sets of balls are used, and so on. Numbers may be played with one tube, open in the chamber 180 and extending thereabove. After a ball has risen to the top of each neck, the total number is read to the players, who have bet on a particular member. For example, if the top ball in the first neck was 2, in the second 4 and in the third 9, the winning number would be 249, with odds of 1,000 to 1. After the number has been read, the valve 108 is closed, and the same balls can be mixed again. Unlike bingo, the balls or lot members in numbers and roulette are reused each time. The neck or tube 188 may be transparent to facilitate reading the numbers.

Roulette is played with 38 balls or lot members representing the possible winning numbers of 1 to 36, 0 and 00. Therefore, 38 balls are placed in the dish with those numbers thereon. To allow the game machine to make a random selection between these game balls, a head attachment similar to the attachment 184, shown in FIG. 6 is used. The difference being that only one neck or tube 188 is used to display one number at a time.

Figure 4:
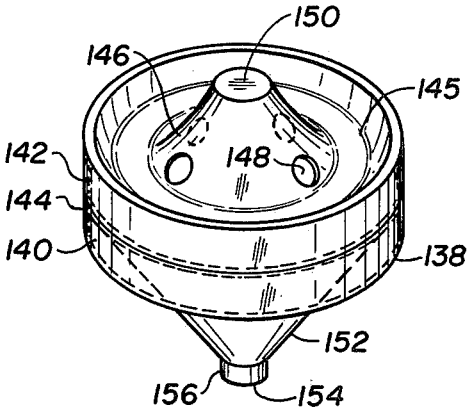
FIG. 4 is a perspective view of a dice head of the invention.
Figure 7:
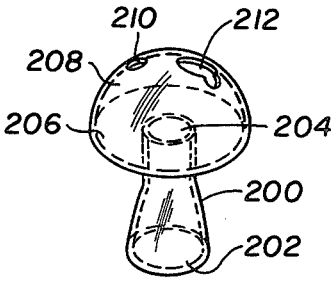
FIG. 7 is a perspective view of a bingo head attachment which is receivable in the universal head of FIG. 6.

FIG. 4 shows an additional head or chamber to be used in place of the universal head for playing many different dice games. The bottom edge of dice head or chamber 138 is placed within the lip 130 of the collar 126 shown in FIG. 1. The dice head is made up of two shallow bowls 140, 142 joined at their convex surfaces, shown as edge 144. An annular trough 145 is formed in the upper bowl 142. A large opening is cut through the center of the dice head or chamber 138. At the lower edge of this opening is a funnel 152 which extends out of the bottom bowl 140. The opening 154 of the funnel 152 fits snugly on the opening 22b in the center of the dish 124. The dice head 138 can also be operated at a distance from the game ball machine by attaching one end of a hose to the cylindrical portion 156 of the funnel 152 and attaching the other end of the hose to either of the openings 22*a* or 26*a* in the valve assembly 8, which are operated by valves 108 and 92, respectively. A stand may be used to support the head. At the top of the opening in the dice head or chamber 138, above the funnel 152 is an inverted funnel-like member 146 with a closed top 150. Four openings 148 are spaced near the base of the funnel-like member 146.

To play craps, 2 dice or lot members are dropped in the openings 148, the vertical air valve 108 is opened and the air is directed so that the dice mix and shoot out through the openings 148 onto the inner surface of the bowl 142 where they roll to a stop and can be read to the players. Some dice games are played with three dice which can be used here as well. Instead of each die, six balls numbered from 1 to 6 may be used. When two balls have emerged from the openings 148, the vertical air valve 108 is closed.

Figure 5:
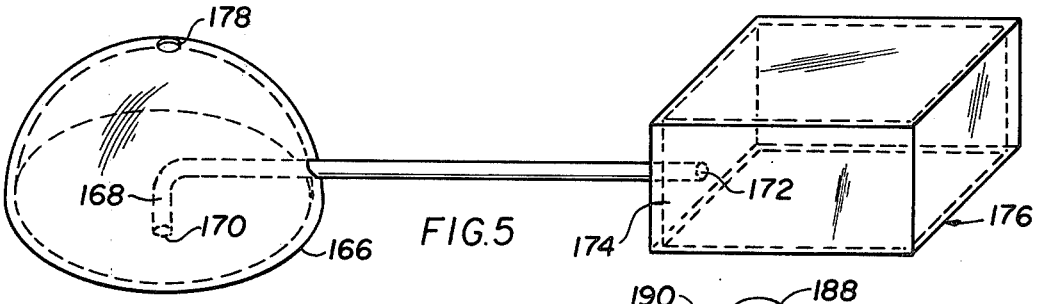
FIG. 5 is a perspective view of the colors head of the invention.

FIG. 5 shows another chamber or head 166 used for the game of colors. The colors head or chamber 166 is disposed on the lip 130 of the collar 126 as are the universal head or chamber 180 and the dice head or chamber 138. A stiff pipe 168 extends from outside the colors head or chamber 166 and makes a 90° turn so that its opening 170 is spaced a distance directly above the opening 22*b* in the dish 124. The pipe 168 is long enough so that it will open into the side wall 174 of a box 176. The box is just large enough to fit over 36 holes in the grid 40. Each area of the flaps 42, 44 which is under one of these 36 holes is painted in one of six different colors. Therefore, each color is used for six areas. Only one ball or lot member is necessary for use in colors. The ball travels horizontally in the dish 124 through the use of the horizontal air valve 92. Air flow is maintained by an air vent 178 pervious to the passage of air at the top of the head or chamber 166. When a number is to be picked, the vertical air valve 108 is opened and the ball travels through the tube 168 from one opening 170 to the other 172 and rolls to a random stop in one of the 36 holes, thereby selecting a color. The odds of landing in a particular color are therefore 6 to 1, but can be varied by using more or less colors. When a new number is desired, the ball is dropped into the box 46 and returned to the dish 124 as is done for bingo. Several balls may be allowed to accumulate in the box 46 and brought to the dish 124 one at a time, or several balls may be allowed to accumulate in the chamber 166 and mixed.

Figure 8:
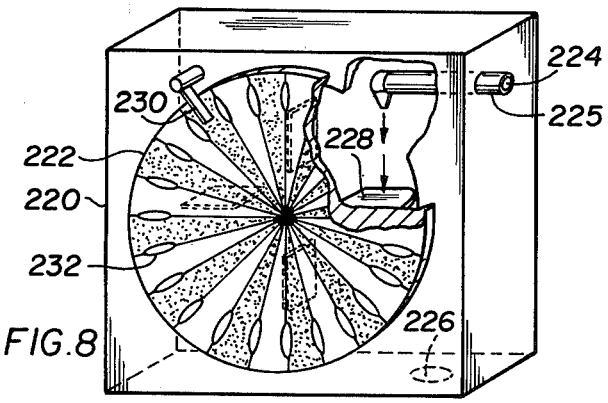
FIG. 8 is a perspective view, partly broken away, of an auxiliary remote display box, shown on a greatly reduced scale.

In FIG. 8 there is seen a remote roulette box 220 which is greatly reduced in size as compared to the parts of the game ball machine shown in the other figures. The roulette box 220 is hung on a wall or stood on a shelf in the game room. A hose is connected at one end to either valve opening 20*a* or 32*a*, and at the other end to the opening 224 in the nozzle 225 which extends through the rear of the roulette box 220. By opening either valve 110 or 114 depending upon which valve opening 20*a* or 32*a*, respectively, is used, air flows from the nozzle 225 in the direction of the arrow and turns the roulette disk or wheel 222 by pushing against fins 228 which extend outwardly behind the disk 222. The air exits the roulette box 220 through vent 226 in the side thereof. When the valve 110, 114 is closed, the wheel 222 comes to a stop. Ridges or U-shaped stops 232 are spaced over the surface of the disk 222. A flexible finger 230 engages these stops 232 and helps to slow the rotation of the wheel 222. Thirty eight divisions are placed on the wheel 222, carrying numbers 1 to 36, 0 and 00. Traditionally, odd numbered divisions are red and even are black, while 0 and 00 are in a third color, such as green. Traditional combination bidding is used in roulette, so that the odds vary. Of course more or less divisions can be used and the divisions can be marked with different odds such as by making smaller divisions pay higher odds.

It is evident that two dice heads 138 can be operated through the use of valves 110 and 92 at the same time that two roulette boxes 220 are operated through the use of valves 114 and 110. Therefore, four different games can be operated simultaneously.

Obviously differently shaped lot members can be used with equal success, such as in the shape of a pyramid, disk, cube or any other solid, for most embodiments of the invention.

There are claimed:

1. A game machine comprising chamber means for receiving therein at least one lot member, valve means for controlling a supply of forced air to said chamber means, means cooperating with said valve means for agitating said lot member in said chamber means so that it freely whirls about said chamber means, and means for capturing and positioning said lot member at random at a location at which a value characteristic of the lot member at said location is displayed, said valve means comprising a self-contained unitary multi-way valve assembly having at least one positive air pressure supply inlet, a multiplicity of positive air pressure outlets each connectible to inlet ends of tubes for supplying air to perform different functions in the game machine, and separate actuators for individually controlling the egress of air from said outlets, said agitating means comprising a first tube having an inlet end connected to one of said valve outlets and an outlet end connected to said chamber means for blowing air in a horizontal direction, and a second tube having an inlet end connected to one of said valve outlets and an outlet end connected to said chamber means for blowing air in a vertical direction.

2. A game machine according to claim 1, wherein said lot member is a die, said chamber means are in the form of a head for playing dice, said capturing and positioning means comprise a bowl-shaped upper portion of said head having an annular trough and formed with openings therein for emitting said die therethrough onto said annular trough, said head being connectible to said valve means.

3. A game machine according to claim 1, including a tubular head attachment partly received in said chamber means and having an end extending out of said chamber means and an open end within said chamber means for receiving said lot member therein under action of the forced air, said end extending out of said chamber means being partly closed to passage of said lot member and pervious to the forced air.

4. A game machine according to claim 3, wherein at least said partly closed end of said tubular head attachment is transparent.

5. A game machine according to claim 1, wherein said chamber means is pervious to the forced air, and said capturing and positioning means comprise a tube for receiving said lot member therein under the action of the forced air, said tube being partly received in said chamber means and having an end extending out of said chamber means and an open end within said chamber means, a box having an open bottom formed therein, said box being connected to said end extending out of said chamber means for receiving said lot member from said tube, a grid disposed at said open bottom of said box for receiving said lot member from said box, and means for returning said lot member to said chamber means.

6. A game machine according to claim 5, wherein said returning means comprise flaps disposed under said grid for retaining said lot member in said grid, a third tube having an inlet end connected to one of said valve outlets and an outlet end connected to an inflatable air bag disposed beneath said flaps for raising said flaps, said flaps being releasable to allow said lot member to fall below said grid, an additional box disposed below said grid for receiving said lot member therein through an opening in said additional box, a hose connected at one end to said additional box and at the other end to said chamber means for returning said lot member therein under the action of the forced air, a fourth tube having an inlet end connected to one of said valve outlets and an outlet end connected to said additional box for forcing said lot member through said hose and a fifth tube having an inlet end connected to one of said valve inlets and an outlet end connected to said additional box for closing-off said opening.

7. A game machine according to claim 6, wherein at least part of said box is transparent, and said grid and flaps have differently colored areas.

8. A game machine according to claim 6, including a sixth tube having an inlet end connected to one of said valve outlets and an outlet end connected to said additional box for agitating said lot member therein.

9. A game machine according to claim 1, wherein said lot member is a ball, and including a tubular head attachment partly received in said chamber means and having an end extending out of said chamber means and an open end within said chamber means for receiving said ball under the action of the forced air, said end extending out of said chamber means being pervious to the forced air and having a hole formed therein, said hole having a diameter slightly smaller than that of said ball, whereby said ball is lodgable in said hole, a grid disposed adjacent said chamber means for receiving said ball after it has been manually removed from said hole, and including means for returning said ball to said chamber means.

10. A game machine according to claim 9, wherein said returning means comprise flaps disposed under said grid for retaining said ball in said grid, a third tube having an inlet end connected to one of said valve outlets and an outlet end connected to an inflatable air bag disposed beneath said flaps for raising said flaps, said flaps being releasable to allow said lot member to fall below said grid, an additional box disposed below said grid for receiving said ball therein through an opening in said additional box, a hose connected at one end to said additional box and at the other end to said chamber means for returning said lot member therein under the action of the forced air, a fourth tube having an inlet end connected to one of said valve outlets and an outlet end connected to said additional box for forcing said lot member through said hose and a fifth tube having an inlet end connected to one of said valve inlets and an outlet end connected to said additional box for closing-off said opening.

11. A game machine according to claim 10, including a sixth tube having an inlet end connected to one of said valve outlets and an outlet end connected to said additional box for agitating said lot member therein.

12. A game machine according to claim 1, including a box for playing roulette connectible to said valve means, said box having a roulette wheel disposed therein, said wheel being rotatable under said action of the forced air, a third tube having an inlet end connected to one of said valve outlets and an outlet end connected to said roulette box for rotating said wheel, and means for randomly selecting and displaying a winning value on said wheel.

13. A game ball machine according to claim 12, wherein said wheel has a front and a rear surface and including fins integral with said rear surface and ridges integral with said front surface, said action of the forced air rotating said wheel by impinging said fins, said selecting means being a flexible finger engageable with said ridges for stopping the rotation of said wheel.

* * * * *